US005440767A

United States Patent [19]

Bergenwall

[11] Patent Number: 5,440,767

[45] Date of Patent: Aug. 15, 1995

[54] DEVICE IN TOILET SEATS

[75] Inventor: Henning Bergenwall, Sollentuna, Sweden

[73] Assignee: Samhall Rehab AB, Sweden

[21] Appl. No.: 211,371

[22] PCT Filed: Sep. 24, 1992

[86] PCT No.: PCT/SE92/00660

§ 371 Date: Jul. 5, 1994

§ 102(e) Date: Jul. 5, 1994

[87] PCT Pub. No.: WO93/06766

PCT Pub. Date: Apr. 15, 1993

[30] Foreign Application Priority Data

Sep. 30, 1991 [SE] Sweden ..... 9102829

[51] Int. Cl.[6] ..... E03D 11/00

[52] U.S. Cl. ..... 4/667; 4/254

[58] Field of Search ..... 4/254, 667; 297/DIG. 10

[56] References Cited

U.S. PATENT DOCUMENTS

| | | | |
|---|---|---|---|
| 3,091,426 | 5/1963 | Bogart | 248/393 |
| 3,473,174 | 10/1969 | Cool | 4/251 |
| 4,185,335 | 1/1980 | Alvis | 4/667 X |
| 4,833,736 | 5/1989 | Sadler et al. | 4/254 X |
| 5,142,709 | 9/1992 | McGuire | 4/667 |

*Primary Examiner*—Charles E. Phillips

*Attorney, Agent, or Firm*—Zarley, McKee, Thomte, Voorhees & Sease

[57] ABSTRACT

A device is intended to make it easier for a person to arise from and/or sit down on a toilet bowl. The device comprises a first member being a part of the toilet bowl or attachable thereto, a second member adapted to carry a sitting surface-forming arrangement and which is vertically movable with respect to the first member, and a linkage defining the movability of the members with respect to each other so that the members are located close to or onto each other in a first relative position and spaced apart in a second relative position.

7 Claims, 4 Drawing Sheets

DEVICE IN TOILET SEATS

FIELD OF THE INVENTION AND PRIOR ART

The present invention relates to a device in toilet seats, said device being intended to make it easier for a person, in particular a person whose movements are hampered, to arise from and/or sit down on a toilet seat.

It is troublesome to many persons, in particular persons whose movements are hampered and old persons, to sit down on and arise from a toilet seat. It is known to arrange different kinds of arrangements for raising the level of toilet seats, so that the sitting surface will be located on a higher level, and supporting arrangement being more or less complicated and handles have also been arranged, which are intended to make it easier for a person when sitting down and arising, respectively. However, these known devices have not resulted in any satisfying solution of the problem.

SUMMARY OF THE INVENTION

The object of the invention is to indicate ways to reduce the problem mentioned above and accordingly create a device which make it substantially easier for persons whose movements are hampered as well as other persons to arise from and/or sit down on the toilet seat.

The vertically movable second member and the sitting surface-forming arrangement formed or carried thereby enables the person to comfortably sit down on the arrangement in the raised position thereof and after that be controllably lowered to a lower position, in which the needs in question may be carried out. The rising of the person from the toilet seat is in analogous way substantially facilitated by the fact that the second member is meant to then be raised, preferably by means of a suitable power device, to the upper position, in which the person may comfortably get off the sitting surface-forming arrangement.

By making the provisions in accordance with the features described herein it is achieved that the sitting surface-supporting arrangement in the raised position of the second member gets located forwardly displaced, so that sitting down and rising are facilitated.

The characteristics according to the features described herein mean further easiness during sitting down and rising by the fact that the sitting surface-forming arrangement is intended do decline forwardly in the raised position.

Further advantages characteristics of the device according to the invention appear from the dependent claims.

BRIEF DESCRIPTION OF TEE DRAWINGS

With reference to the appended drawings, below follows a specific description of an embodiment according to the invention cited as an example.

In the drawings:

FIG. 1 is a schematic side elevation of the device according to the invention, a toilet seat co-ordinated therewith being drawn by dashed lines, FIG. 2 is a perspective view of the device, but with a lid tilted down and a power means removed, FIG. 3 is a view of the device in the position according to FIG. 2 shown obliquely from below, and FIG. 4 is a perspective view of the device in the folded position thereof.

DETAILED DESCRIPTION OF A PREFERRED EMBODIMENT

Figure 1:
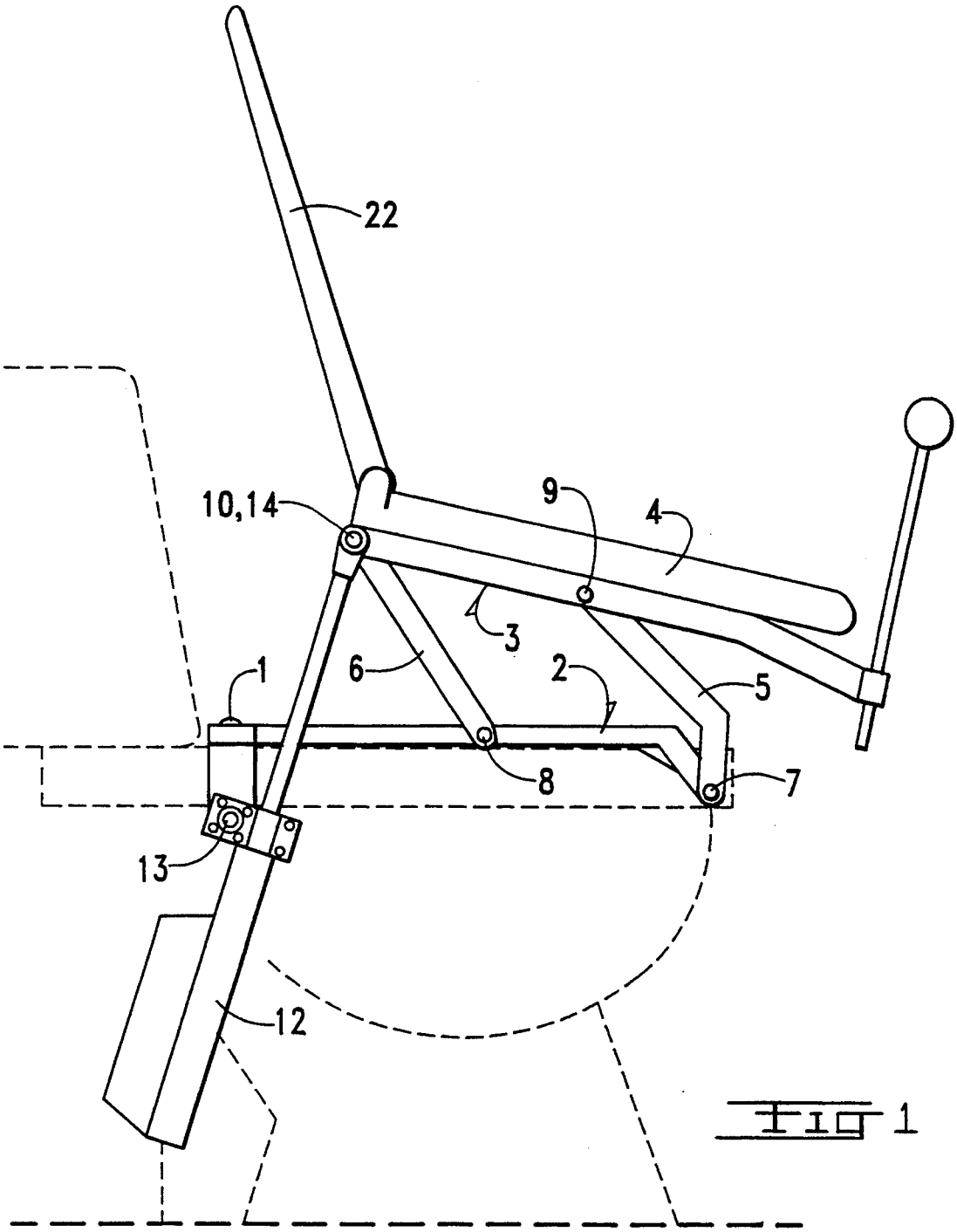

The device illustrated in the drawings is intended to be attached to a toilet seat in the way indicated in FIG. 1. It is preferred that the toilet seat is of such conventional type which close behind the toilet bowl has bores for receiving fastening means belonging to the unit normally attachable to the toilet seat and having at least a sitting surface-forming arrangement, normally in the form of a ring, and suitably also a lid. The device according to the invention is in the preferred case intended to be in an analogous way attachable to the toilet seat, namely by means of two bolts, pins or the like 1, which are intended to engage into said bores.

Figure 2:
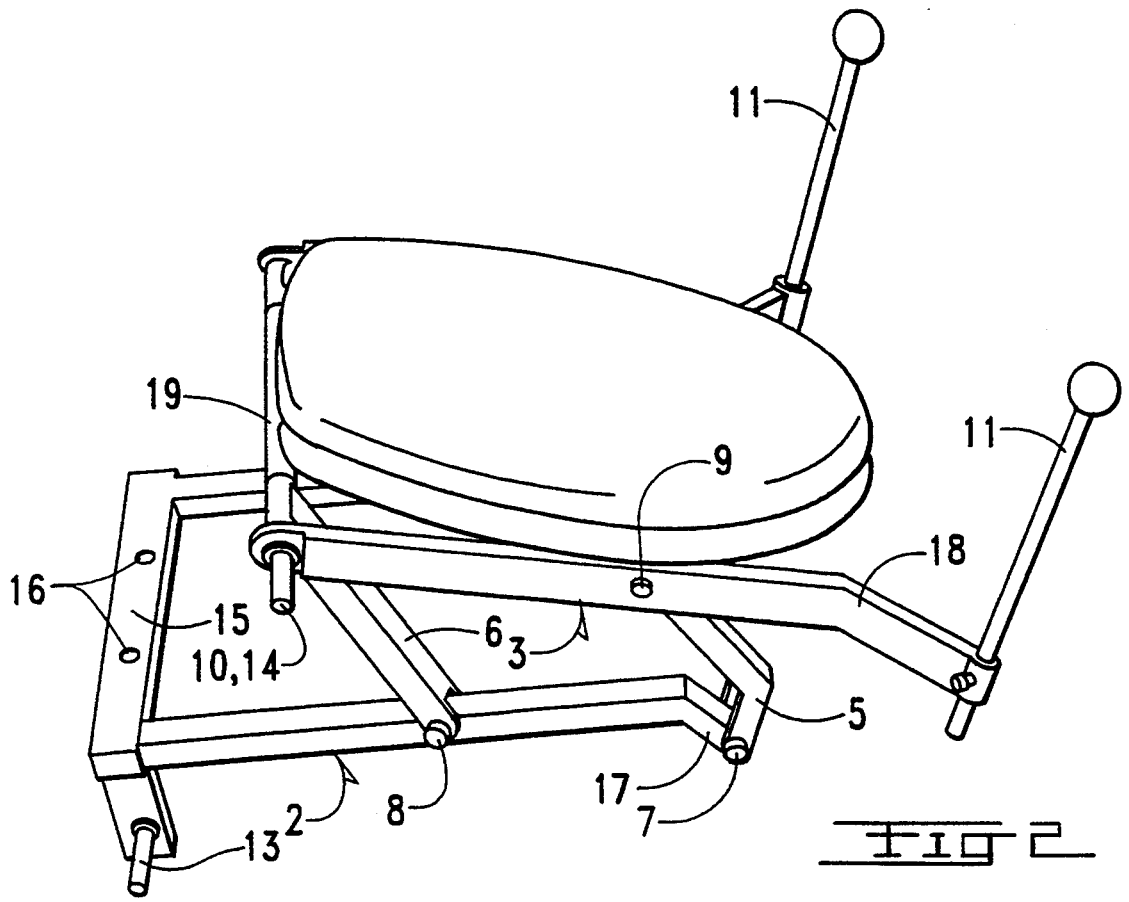
Figure 3:
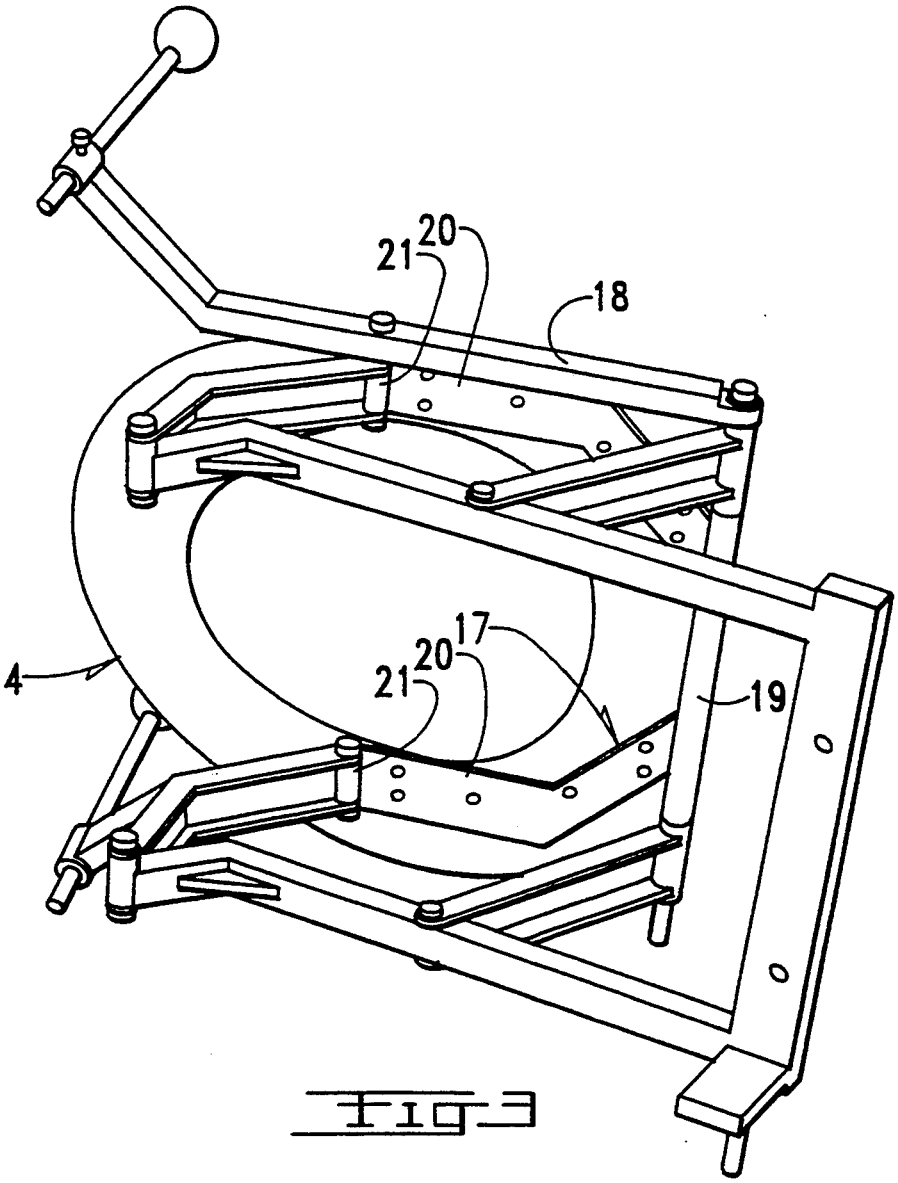

The device comprises a first member 2 applicable to the toilet bowl, a second member 3, which is adapted to carry a sitting surface-forming arrangement 4 and which is vertically movable with respect to the first member 2, and means 5, 6 defining the movability of the members 2, 3 with respect to each other so that these are located close to or onto each other in a first relative position (FIG. 4) and spaced apart in a second relative position (FIG. 1–3).

Figure 4:
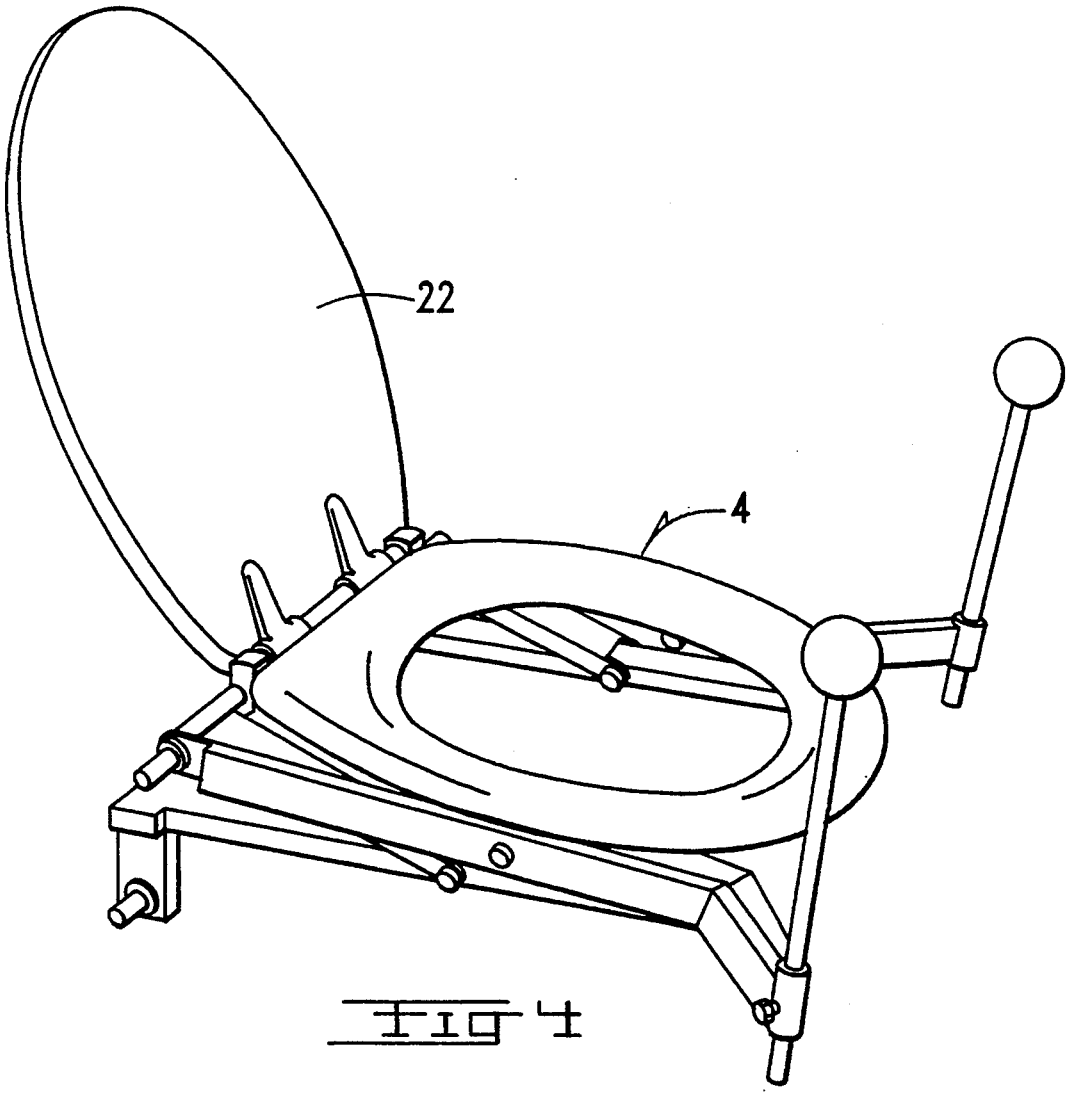

The movement defining means 5, 6 are adapted to in the second relative position according to FIG. 1–3 locate the second member 3 so that the sitting surface-forming arrangement 4 becomes forwardly displaced with the position thereof in the first relative position (FIG. 4).

Furthermore, it is preferred that the movement defining means 5, 6 are adapted to in the second relative position (FIG. 1–3), i.e. in the position in which the member 3 is raised with respect to the member 2, locate the second member 3 so that the sitting surface-forming arrangement 3 declines forwardly. It is by that understood that it is the very sitting surface that is substantially located in a plane declining forwardly.

The movement defining means 5, 6 have the form of links hingedly connected with the first and second members 2, 3 through axes 7–10. It is preferred that the links 5, 6 and the first and second members 2, 3 forms at least a hinged quadrangle. It is according to the invention particularly preferred that the hinged quadrangle is a hinged parallelogram.

The links 5, 6 and the first and second members 2, 3 form preferably two hinged quadrangles, namely one at each side of the toilet seat. It is understood that the links 5, 6 are pivoted in planes along the toilet seat and accordingly that the hinge axes 7–10 extend substantially transversally to the toilet seat.

The links 5, 6 are arranged to pivot upwardly/forwardly from the positions thereof according to FIG. 4, in which they are pivoted maximally downwardly, upon raising of the second member 3.

The hinge axis 7 between the foremost 5 of the links and the first member 2 is located on a level below a horizontal plane through the hinge axis between the hindmost 6 of the links and the first member. Furthermore, it is preferred that the second member 3 is provided with a handle 11 and arm rests not shown as a complement for an alternative thereto.

A power means 12 ( FIG. 1) with variable length is arranged to produce the relative movement between the first and second members 2, 3. This power means is fastened at points on the first member and on the second member in such a way that the prolongation of the extension of the power means between these points gives rise to pivoting of the member 3 upwardly/forwardly, while a shortening of the power means between these points gives rise to a lowering/movement rearwardly of the second member 3.

It is preferred that one single power means is arranged and that this is arranged on one side of the toilet seat. This power means may more exactly be pivotally journalled with respect to the lower part about an axis 13, whereas the power means are pivotally journalled with respect to the upper member about an axis 14. The hinge axis 10 for the two hindmost links 6 previously described coincides in the illustrated example with the axis 14. It would be possible to form the geometric axis 10 and 14 of one and the same real axle and such an embodiment is illustrated in the drawings.

It appears especially from FIG. 2 and 3 how the first member 2 may be substantially U-shaped, the base 15 of that member being thought to have the securing means 1 previously described or bores 16 for receiving thereof. The two pairs of links 5, 6 are hingedly connected to the legs of the U, the foremost links 5 at the outer ends of the legs and the hindmost link 6 in the region of the middle portions of the legs. Accordingly the first member 2 is intended to have the character of a framework, which is to be anchored or secured to the toilet seat. It should be mention that a device according to the invention could be modified so that the first member 2 could be an integral part of the toilet seat, i.e. consist of a portion thereof. Thus, the movement defining means or links 5, 6 would in such a case be hingedly connected to the toilet seat through the axes 7, 8.

The lower member 2 at the front region of the toilet seat has downwardly extending portions 17, at the front parts of which the hinge axes 7 are arranged, in order to obtain a location of the hinge axes 7 of the foremost links 5 below a horizontal plane through the hinge axes 8 of the hindmost links 6. In the example having a lower member 2 being substantially U-shaped these portions 17 are arranged at the outer end of the legs and these portions 17 more exactly extend so downwardly that the hinge axes 7 become located below that upper substantially horizontal surface which is located annularly around the upper opening of the toilet bowl.

It appears especially from FIG. 3 how primarily the foremost links 5, but in the example also the hindmost links 6, have a substantially U-like cross-section shape with the legs of this U directed downwardly, so that these legs become located on each side of portions of the legs of the U-shaped lower framework 2, when the links 5, 6 are pivoted down. Concerning the foremost links 5 it is also preferred that they are side-face bent approximately in correspondence with the end portions of the legs of the U-shaped framework part 2, so that the legs directed downwardly of the links 5 in the position in which the upper member 3 is pivoted down laterally overlap the portions 17 of the framework part 2.

It appears also from FIG. 3 how the second member 3 may be composed by several different elements, namely a substantially U-shaped element 17 and two elements 18 located at the sides of the device. The element 17 first mentioned may have a base 19 formed by a sleeve 19, which is intended to be penetrated by the real axle, which forms the geometric axis 10 and/or 14 already mentioned. The U-shaped element 17 has also legs 20, which extend forwardly in the device and to which a sitting surface-forming arrangement 4 is fixed. Sleeves or the like 21, through which the real axles forming the geometric axes 9 extend, may be arranged at the outer ends of the legs 20. As it appears from the figures, the elements 18 are hingedly connected to the links 5, 6 through the axes 9 and 10, 14. The real axles forming the geometric axes 9, 10, 14 extend in the example also through the elements 18. The links 5, 6 may have legs or ears and sleeves, respectively, at the ends thereof, which are also penetrated by the real axles forming the geometric axes 7–10.

As it appears form the figures, a pivotable lid 22 may be added to the sitting surface-forming arrangement 4. Furthermore, the handles 11 may be designed at least vertically adjustable, for instance by arranging the handles displaceably received in sleeves or the like secured to the elements 18, said sleeves being associated with means for locking the handles in the position set.

The user of the device or a person serving said user is intended to, when using the device according to the invention, have access to a suitable actuating means, the influence of which gives rise to prolongation and shortening, respectively, of the power means. As in order to get prepared for sitting down on the toilet seat, the arrangement 4 is operated into the upper position according to FIG. 1, in which the person may comfortably sit down on the raised sitting arrangement declining forwardly. The actuating means is after that controlled for contraction of the power means 12, which gives rise to a movement of the sitting arrangement 4 towards the lowered position according to FIG. 4, in which the user is intended to carry out his needs. When the user after that is going to arise from the toilet seat, the sitting arrangements is firstly operated into the position according to FIG. 1, so that arising may take place as easily as possible.

A particular advantage of the device according to the invention as described above constitutes by the fact that at least one side is designed so open that, when the second member 3 is raised with respect to the first one 2, a person sitting on the sitting arrangement 4 or a person serving this person may laterally get access to the bottom region of the sitting person by the hand or carrying out the cleaning operations required after the person sitting on the device has carried out his needs. As being particularly apparent from FIG. 1, the open construction is present on one hand within the hinged quadrangle, which laterally seen is created by the axes 7–10 (i.e. the space between the links 5, 6), and on the other in front of the foremost links 5 and behind the hindmost links 6.

The device described may of course be modified in several ways within the scope the inventional idea.

I claim:

1. A device mounted on a horizontal upper surface of a toilet bowl, said device being intended to make it easier for a person, in particular a person whose movements are hampered, to rise from and/or sit down on the toilet bowl and comprising a first member being attached to the upper horizontal surface of the toilet bowl, a second member carrying a sitting surface-forming arrangement having a front and rear portion and being vertically movable with respect to the first member, and means defining the movability of the second member with respect to the first member so that said members are located close to each other in a first relative position and spaced apart in a second relative position, the means defining the movability being adapted to locate, in said second relative position, the second member so that the sitting surface-forming arrangement assumes a position above said first member with said front portion extending forwardly of said toilet bowl and said rear portion inclined with respect to said front portion, the means defining the movability being in the form of foremost and hindmost links pivotably connected between the first and second members through first and second pivot axes, said links being arranged to pivot upwardly and forwardly upon raising the second member, characterized in that said first pivot axes between foremost of the links and the first member are located on a level below a horizontal plane through said second pivot axes between hindmost of the links and the first member wherein the first member at a front region thereof has portions extending downwardly below the horizontal surface of the bowl, said first pivot axes are attached near a lowermost end of said portions extending downwardly such that the first pivot axes at all times are located below the horizontal surface of the toilet bowl.

2. A device according to claim 1, characterized in that the foremost and hindmost links (5, 6) and the first and second members (2, 3) form at least one hinged quadrangle.

3. A device according to claim 2, characterized in that the hinged quadrangle is a hinged parallelogram.

4. A device according to claim 2, characterized in that the foremost and hindmost links (5, 6) and the first and second members (2, 3) form two hinged quadrangles, namely one at each side of the toilet seat.

5. A device according to claim 1, characterized in that a power means (12) having a variable length is adapted to produce a relative movement between the first and second members (2, 3).

6. A device according to claim 1, characterized in that the second member (3) is provided with handles (11).

7. A device according to claim 1, characterized in that said device is made so open on at least one side that a person sitting on the sitting arrangement (4) or a person serving that person is able to laterally reach the bottom region of the person by the hand when the second member is raised with respect to the first one.

* * * * *